US005269251A

United States Patent [19]

Freeman

[11] Patent Number: 5,269,251

[45] Date of Patent: Dec. 14, 1993

[54] TRAFFIC SAFETY CONTROL SYSTEM AND METHOD

[75] Inventor: Donald H. Freeman, Clifton, N.J.

[73] Assignee: Continental Safety Supply Co., Clifton, N.J.

[21] Appl. No.: 907,827

[22] Filed: Jul. 2, 1992

Related U.S. Application Data

[63] Continuation-in-part of Ser. No. 770,639, Oct. 3, 1991, abandoned.

[51] Int. Cl.[5] ..... E01F 9/01

[52] U.S. Cl. ..... 116/63 C

[58] Field of Search ..... 116/63 P, 63 C; 40/612, 40/607; 404/9, 10

[56] References Cited

U.S. PATENT DOCUMENTS

| | | | |
|---|---|---|---|
| 2,838,744 | 6/1958 | De Wald | 115/63 P |
| 3,732,842 | 5/1973 | Vara, Sr. | 116/63 C |
| 3,782,322 | 1/1974 | Wilson | 116/63 P |
| 3,802,378 | 4/1974 | Kessler | 116/63 P |
| 3,933,118 | 1/1976 | Lyons et al. | 116/63 P |
| 3,938,465 | 2/1976 | Lyons | 116/63 P |
| 4,197,808 | 4/1980 | Kinninger | 116/63 C |
| 4,772,869 | 9/1988 | Grammas et al. | 116/63 C |
| 4,925,334 | 5/1990 | Beard | 116/63 C |

FOREIGN PATENT DOCUMENTS

| | | | |
|---|---|---|---|
| 0819373 | 8/1969 | Canada | 116/63 C |
| 0325255 | 7/1989 | European Pat. Off. | 116/63 C |
| 2587050 | 3/1987 | France | 116/63 C |
| 2182701 | 5/1987 | United Kingdom | 116/63 C |
| 2214209 | 8/1989 | United Kingdom | 116/63 P |

*Primary Examiner*—William A. Cuchlinski, Jr.
*Assistant Examiner*—John L. Beres
*Attorney, Agent, or Firm*—W. Patrick Quast

[57] ABSTRACT

A traffic safety control system is described in which connection of standard information signs, standard flags and staffs, standard barricade rope and standard barricade tape, and standard chemical light sticks to standard traffic cones is facilitated by the use of special adapters. Battery operated warning lamps connected directly to standard traffic cones provide an additional safety factor when the system is utilized to perimeterize a traffic control area.

23 Claims, 10 Drawing Sheets

TRAFFIC SAFETY CONTROL SYSTEM AND METHOD

This application is a continuation in part of copending application Ser. No. 07/770,639, filed Oct. 3, 1991, now abandoned.

BACKGROUND OF THE INVENTION

This invention relates to traffic control systems and methods, and in particular to such systems and methods which rely on the use of traffic cones.

Markers for quickly indicating to motorists and pedestrians hazardous areas to avoid, or directions in which they should proceed, are today often in the form of "traffic cones", i.e. brightly colored, cone shaped traffic markers. Traffic cones are usually hollow, light weight markers made of an elastomeric material to minimize damage to persons or vehicles which may accidentally collide with them. They are manufactured in large quantities and are relatively inexpensive, which permits their ubiquitous use in traffic control.

While traffic cones have proven extremely successful in delineating traffic areas of concern, they have not normally been employed to provide traffic information. For example, in a total traffic safety control system information signs such as "No Parking", "Caution-Wet Floors", "Warm Zone", "Cold Zone", etc. are required. Also to perimeterize a given area, barricade tapes, barricade ropes, and flags (usually red, indicating danger) are essential. And in areas of poor visibility or at night chemical light sticks and/or blinking warning lights are often of vital importance.

Attempts have been made to increase the utility of traffic cones as is evidenced by U.S. Pat. No. 4,197,808 which teaches a sign being made to directly connect to an open end of a traffic cone. Again, U.S. Pat. No. 4,772,869 teaches a specially designed square shaped traffic cone that can accept special information signs and a special warning light. And U.S. Pat. No. 4,925,334 teaches the use of a special traffic cone having special side orifices to accept flag staffs for flag display or sign display, and connection of a rope between several of these special traffic cones, and two embodiments of a collar to fit over the neck of the special traffic cone to either make a traffic sign in itself, or to form a holder for a battery operated warning lamp. While these inventions extend the utility of traffic cones, they do not provide for a system of total traffic safety control making use of standard traffic cones, standard signs, standard flags with staff, standard barricade rope and standard barricade tape addressed by the instant invention.

SUMMARY OF THE INVENTION

A primary object of the present invention is to provide a total traffic safety control system making use of standard traffic cones.

Another object is to accessorize standard traffic cones to a greater degree than has heretofore been possible.

An additional object is to provide an economical and easy to manufacture traffic control system.

A further object is to provide maximum safety and maximum control in an inexpensive manner for traffic safety control, thereby reducing user liability.

These and other objects of the instant invention are obtained in this traffic safety control system.

Traffic cones are available in a variety of sizes, those being approximately 28" to 36" in height have been found generally well suited for most traffic control problems. Most traffic cones are hollow with an opening at the top of the narrow portion of the cone. They are usually fabricated in rubber or an elastomeric plastic material. By the very nature of traffic control the methods employed must be fast and easy to do, and, of course, practical from an economic point of view. Currently, traffic cones are readily available, together with a variety of relatively standard plastic signs, standard flags with staff, standard barricade tapes and barricade ropes to block off an area, and methods for illuminating a traffic controlled area including chemical light sticks and battery operated warning lamps. At least some, and often all of these traffic control devices are routinely used in a limitless variety of ways depending on circumstances. This invention provides a convenient system for the full utilization of all readily available traffic control accessories by fast and simple connection to the readily available traffic cones.

To accomplish this, the instant invention makes use of multi-purpose adapters for connection to the top, narrow portion of a traffic cone. Standard commercially available 80 gauge polyvinyl chloride (PVC) pipe and pipe couplings are used to fabricate the adapters. For example, a 1½" PVC pipe is cemented onto a 1½" PVC coupling. By cutting a 1/16", wide slot in the free end of the PVC pipe, the open end of the PVC coupling can now be slipped over the top of the traffic cone, and the PVC pipe portion of this plastic adapter can now be employed to hold whatever information sign is required by simply slipping the base of the sign into the adapter slots. Polyvinyl chloride (PVC) pipe and couplings are extremely well suited to this application, being inexpensive, tough, virtually weather proof, and highly resistant to corrosive chemicals.

Again, taking the same example of PVC pipe as above, a ¼" wide groove can be cut into the walls of the free end of the pipe, and a ⅜" diameter hole cut at the base of this groove, so that a barricade rope up to ⅜" in thickness can be secured to this adapter.

Since this adapter is hollow a flag staff and flag (with a suitable "stop" taped to the flag staff so that it will position the flag at a selected height) can be placed in the open end of the PVC pipe.

In this configuration a simple spring tension barricade tape clip can be used to connect barricade tape securely to the adapter. It should also be noted that this spring tension barricade tape clip can also be used without said adapter, i.e. by connecting the barricade tape directly to the traffic cone. And, in a simple modification of this adapter, a recessed area can be located in the middle portion of the adapter to accommodate a special snap on holder, which holder can then be used to firmly secure the barricade tape to the adapter.

To provide illumination at night or during periods of poor lighting conditions a chemical light stick (e.g. Cyalume Light Stick, made by American Cyanamid Company, Chemical Light Department, Milton, Fla. 32570. Cyalume is a registered trademark of American Cyanamid Company.) can be employed. A thimble like adapter is provided to fit into the top opening of the adapter, with the open end of the thimble adapter pointing upwards so as to provide a convenient snap fit for one end of the chemical light stick after said light stick has been bent and shaken to mix its chemical contents, thereby producing light.

When the invention is used to perimeterize an area by means of barricade tape and barricade rope, safety can be further increased by using a battery operated warning lamp for direct insertion into a traffic cone. The heavy battery portion of the lamp slips into an opening at the top of the traffic cone, giving "ballast" for the lamp. The neck portion of the lamp extends laterally beyond the top portion of the traffic cone forming a platform for the lamp, and a convenient area for securing a barricade rope or barricade tape to the traffic cone by encircling this neck portion of the lamp with barricade tape and/or barricade rope. Used in this manner in conjunction with at least two other traffic cones, the warning lamp now becomes part of a perimeterized traffic safety control area. Thus in one traffic safety control system a rapid, economically practical method for the full utilization of available traffic control accessories is provided, so that a maximum degree of traffic control can result, and liability thereby be reduced.

Obviously other materials can be employed in fabricating the PVC adapters described. These can be other plastics, or metal such as brass or steel, etc. The adapters can be supplied in a variety of base diameters (to accommodate traffic cones of various sizes), and a variety of top lengths and outside diameters to accommodate signs, flag staffs, etc., of varying dimensions.

DESCRIPTION OF THE PREFERRED EMBODIMENTS

Figure 1:
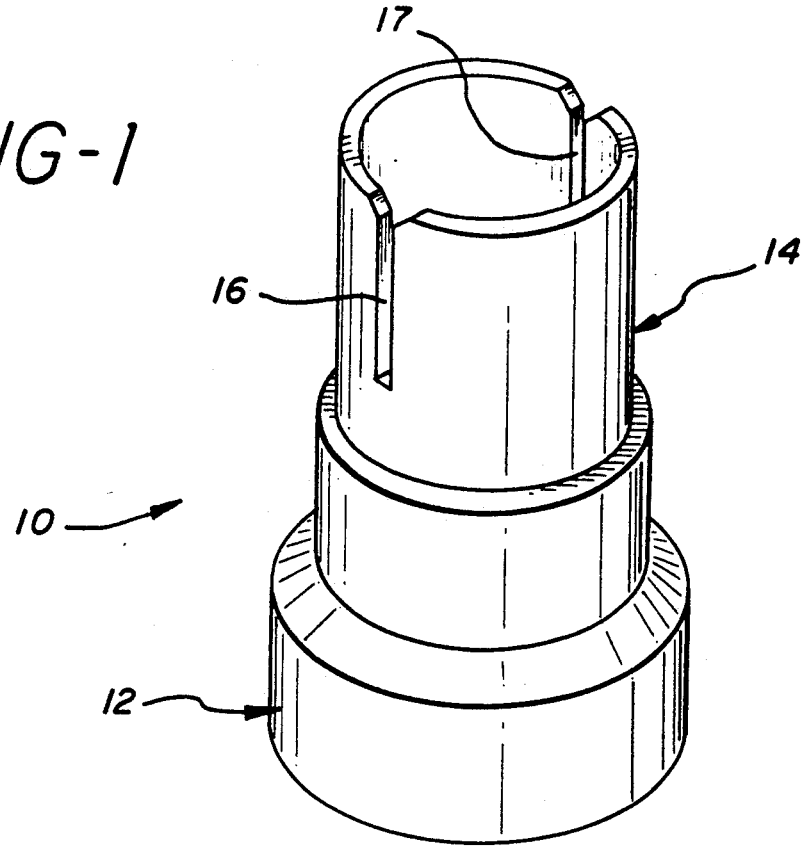
FIG. 1 shows one possible embodiment of the adapter of the invention showing a slot for the placement of an information sign.

Referring now to FIG. 1, an adapter 10 for securing information signs to a traffic cone is shown. This adapter 10 is of two piece construction, the base 12 portion being an 80 gauge, hollow cylindrical 1½" PVC (polyvinyl chloride) pipe coupling, and the top 14 portion of adapter 10 being an 80 gauge, hollow cylindrical 1½" PVC pipe. Base 12 and top 14 of adapter 10 are cemented together for stability in actual use. A vertical slot 16 is approximately 1/16" wide by 1¼" long is cut out of the free open end of top 14, and an identical vertical slot 17 is cut out of the opposite wall of the free, open end of top 14. Both the PVC pipe and the PVC pipe coupling which form the material of construction for adapter 10 are relatively inexpensive and are easily obtained commercially available plastic items. To use adapter 10, base portion 12 is simply placed over the conical top of the traffic cone, where its full 360 degree circumference forms a secure friction fit to the top of the traffic cone. Standard information sign 46 (FIG. 5) indicating for example, "Danger", "No Parking", "Caution-Wet Floor", etc., can now be inserted into slots 16 and 17 in adapter 10.

Figure 2:
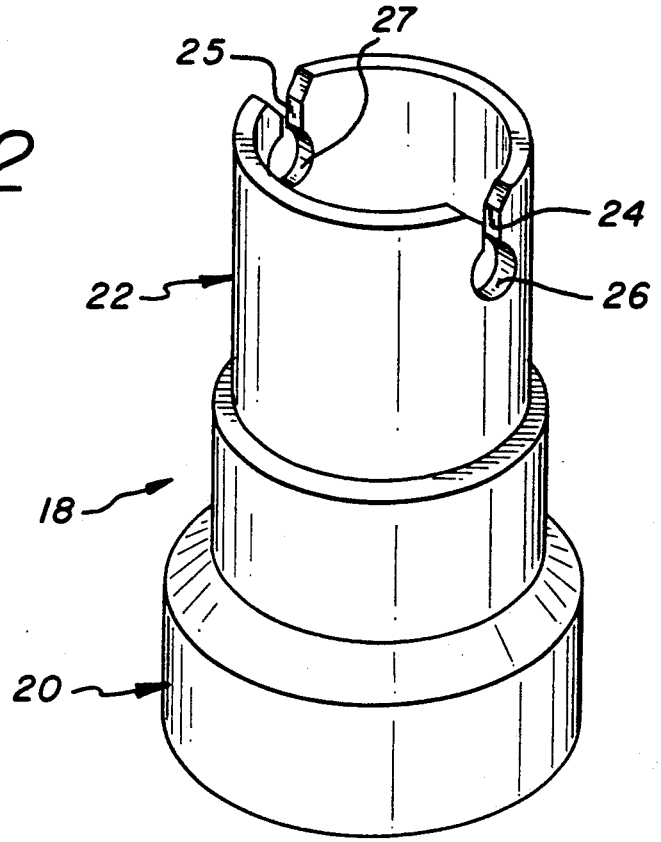
FIG. 2 shows one possible embodiment of the adapter of the invention showing a combination slot and hole for securing a barricade rope.
Figure 6:
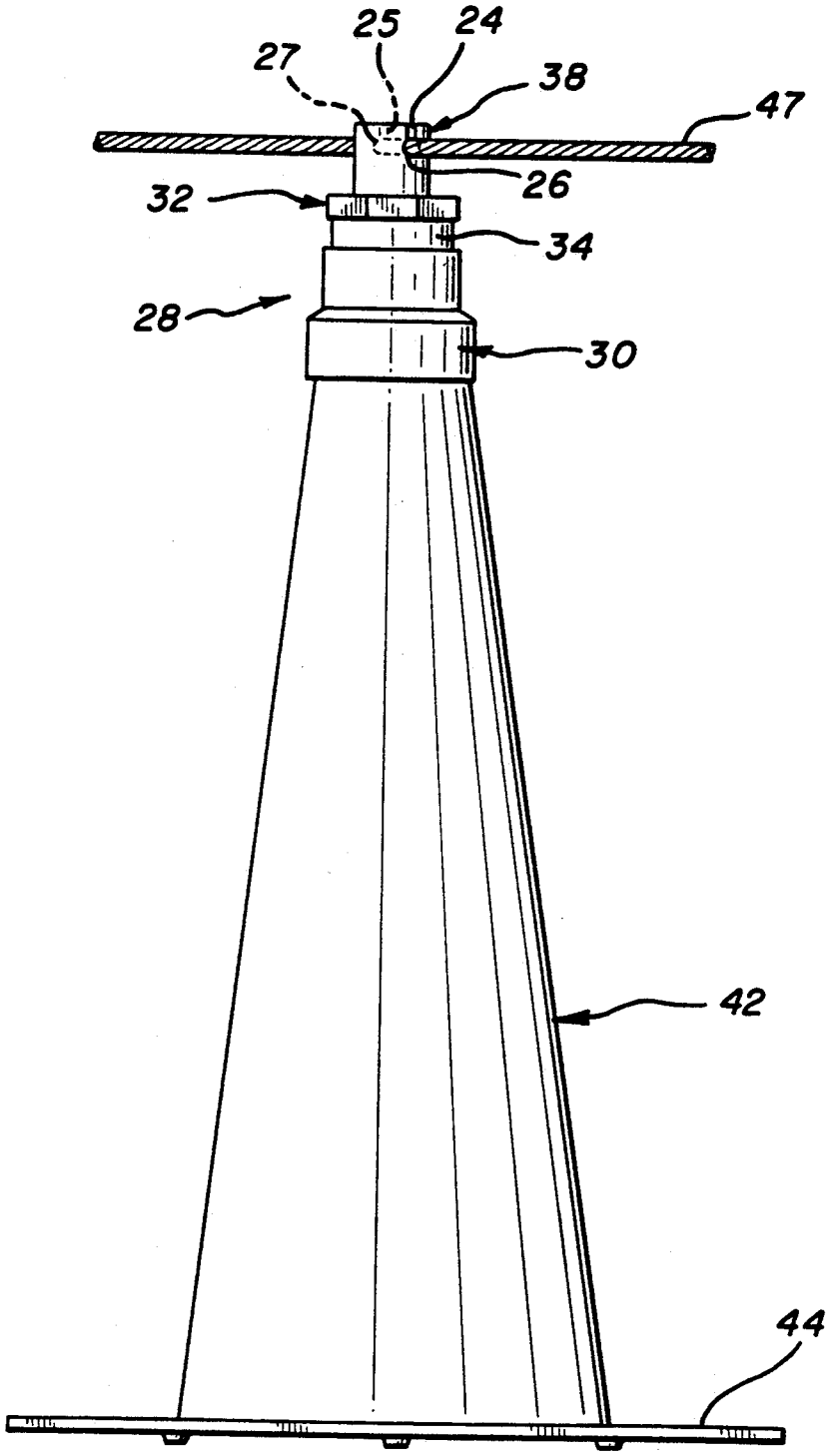
FIG. 6 is a perspective view of one possible embodiment of the traffic control system of the invention showing an adapter connected to a traffic cone with a barricade rope in place on the adapter.

FIG. 2 illustrates a similar adapter 18 to adapter 10 of FIG. 1, but shows a different cut-out wall portion which is designed to accommodate a barricade rope 47 (FIG. 6). This adapter 18 is also made from an 80 gauge 1½" PVC pipe coupling 20 and an 80 gauge 1½" PVC pipe 22 which are cemented together for stability. A vertical cut-out 24 and 26 (FIG. 3) is made in the wall of the free, open end of top 22, and an identical vertical cut-out 25 and 27 (FIG. 3) is made in the opposite wall of the free, open end of top 22. Cut-outs 24 and 25 can begin, for example, with a ¼" wide vertical slot beginning at the open end of top 22, and proceeding downward approximately ¼" towards base 20, cut-outs 24 and 25 ending in second cut-outs 26 and 27 which enlarge the slots in a circular manner, and extend the combined cut-outs (24, 26, and 25, 27) and additional ⅜" toward base 20. The purpose of cut-outs 24,26 and 25,27 is to permit the convenient insertion and securing of a barricade rope 47 (FIG. 6) into adapter 18. To use adapter 18 the open end of base 20 is simply secured to the conical top of a traffic cone, and the barricade rope 47 (which in this particular case can be up to ⅜" thick) is placed diagonally over vertical slots 24 and 25, and then pushed downward until it is secured, but freely threadable, through circular slots 26 and 27. Obviously many other slot configurations can be employed to secure a barricade rope to an adapter, as, for example, drilling a suitable hole through opposite walls of the adapter top 22, etc.

Figure 3:
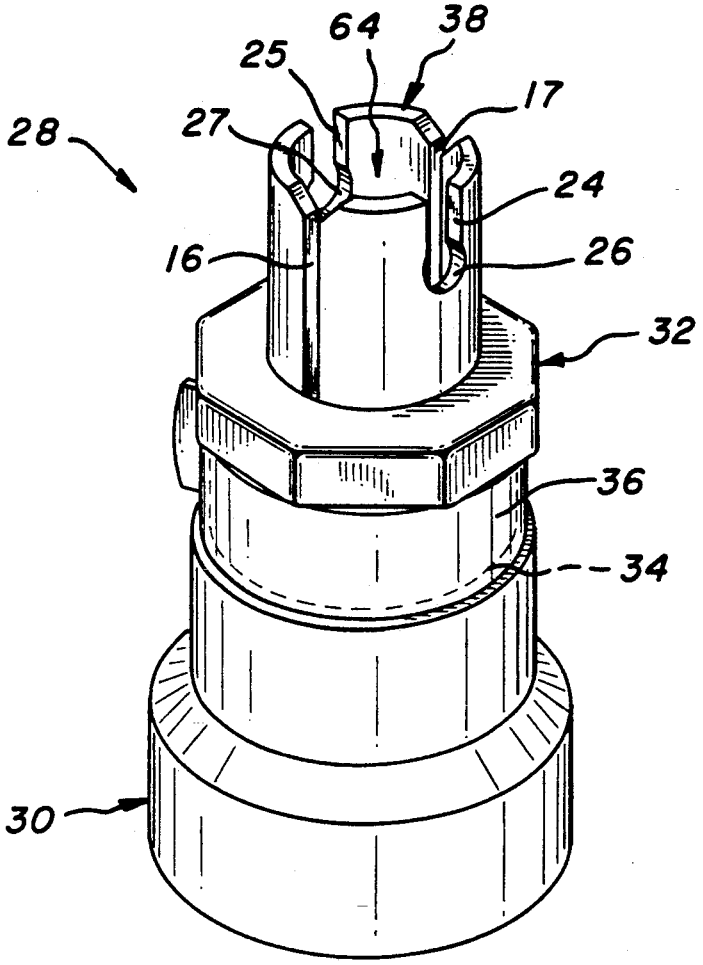
FIG. 3 shows one possible embodiment of the adapter of the invention showing slots for sign placement, combination slots and holes for securing a barricade rope, and a barricade tape snap on holder in place on the adapter.

FIG. 3 shows a preferred arrangement for combining the vertical slots in the adapters of FIG. 1 and FIG. 2 into one adapter. In this embodiment adapter 28 comprises three cemented parts; an 80 gauge, hollow 1½" PVC coupling which forms base 30; and 80 gauge hollow 1½"×¾" PVC reducer which forms middle portion 32; and an 80 gauge hollow PVC pipe which forms top portion 38. This adapter has both the vertical slots 16 and 17 as shown in FIG. 1, together with vertical slots 24,26 and 25,27 as shown in FIGS. 2 and 3 placed at approximately right angles to each other. The somewhat larger O.D. of this base 30 (2¾") demonstrates the ease with which commercially available PVC pipe couplings can be used to accommodate most sizes of generally encountered traffic cones. Adapter 28 also has a recessed area 34, so that barricade tape 52 (FIG. 7) can be easily held in place on a traffic cone with barricade snap on holder 36.

To use adapter 28, base 30 is simply slipped over the conical top of a traffic cone, and an information sign 46 can be secured in vertical slots 16 and 17, or a barricade rope 47 can be secured in combination vertical slots 24, 26 and 25, 27. If a hole (not shown) is provided near the middle of the base portion of sign 46 the barricade rope can be threaded through this hole as well as slots 24, 26, and 25, 27 so that both a sign and a barricade rope can be used on this one adapter 28 simultaneously. Recess 34 in middle portion 32 provides for the convenient attachment of barricade tape to adapter 28 by means of special barricade tape snap on holder 36.

Obviously many other arrangements can be made to combine both sign securing slots 16 and 17 and barricade rope slots 24, 26, and 25, 27 into one adapter, including placing the barricade rope securing slots above sign securing slots, etc. Adapters 10, 18, and 28 illustrated in FIGS. 1, 2, and 3 are shown to be easily and inexpensively fabricated from readily available plastic items to indicate the practical nature of the invention. Many other materials of fabrication can be employed, as, for example, polyethylene, or metals such as brass or steel. And a variety of other dimensions can be used to fabricate adapters to accommodate a variety of different dimensions for traffic cones, signs, barricade rope and tape, and flags and flag staffs.

Figure 4A:
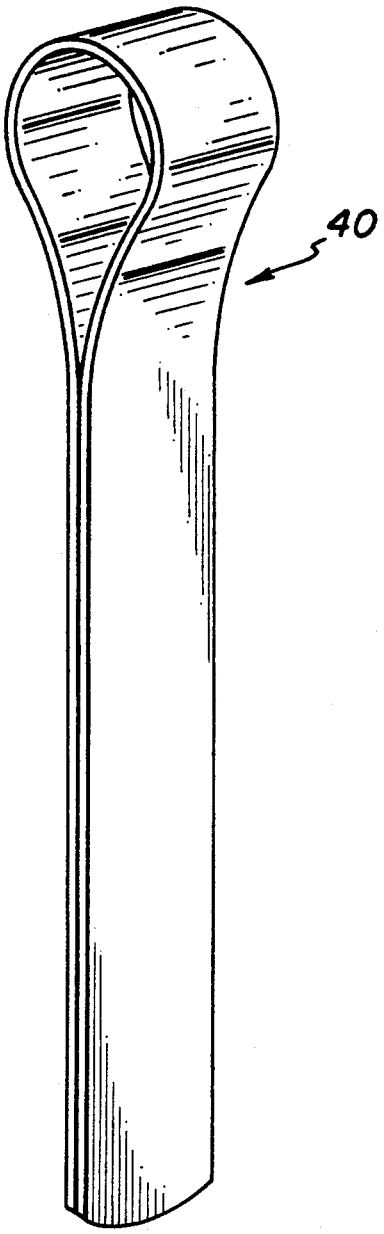
FIG. 4A is a plan view of a spring tension barricade tape holder.
Figure 9:
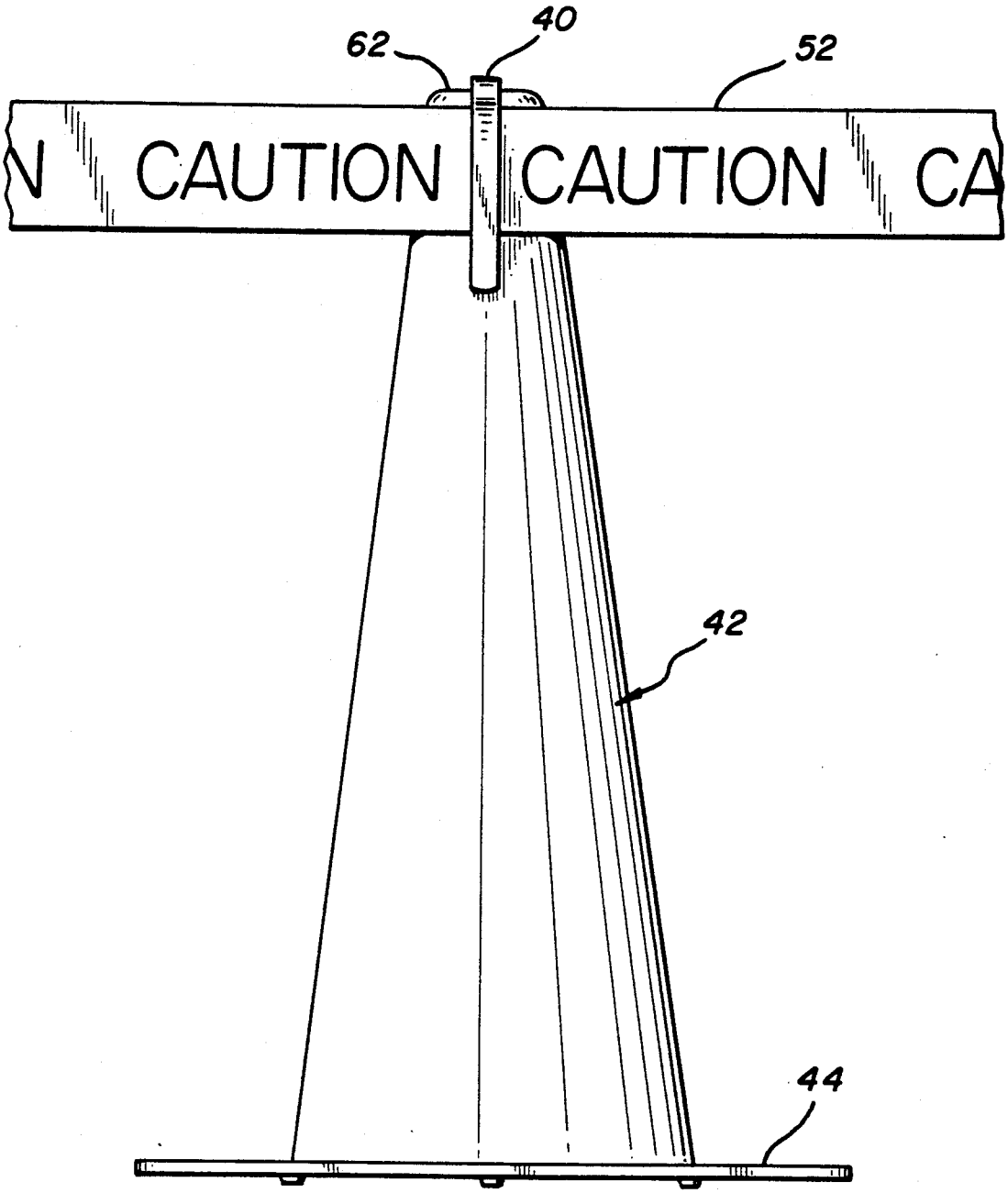
FIG. 9 is a perspective view of one possible embodiment of the traffic control system of the invention showing a spring tension barricade tape clip on top of a traffic cone, part of the spring tension clip shown in phantom within the top of the traffic cone, securing a barricade tape to the traffic cone.

FIG. 4A shows barricade tape spring tension clip 40. Spring tension clip 40 can be fabricated in stainless steel or a resilient plastic, etc. It can be used to secure barricade tape directly to a traffic cone. On end slips into the opening at the top of the traffic cone, while the other end goes over the barricade tape, frictionally securing said tape in place on said traffic cone. Spring tension clip 40 can also be used in a similar manner in conjunction with the above described adapters. FIG. 9 shows spring tension clip 40 frictionally securing barricade tape 52 to traffic cone 42 and its base 44 by means of inserting one end of the spring tension clip into opening 62 in the traffic cone, and having the other end of the clip go over barricade tape 52, thereby frictionally securing said tape to said traffic cone.

Figure 4B:
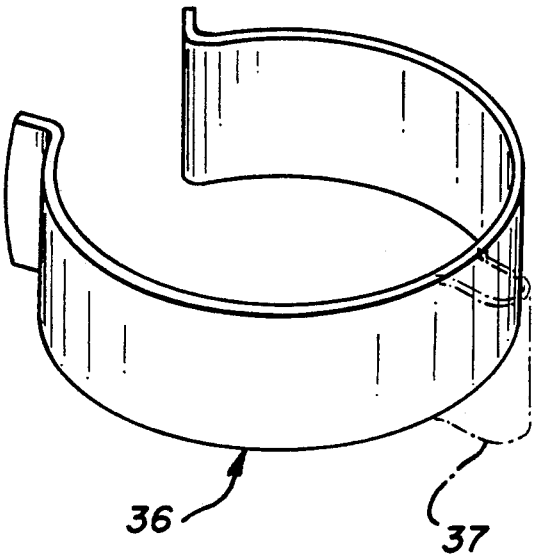
FIG. 4B is a plan view of a snap on barricade tape holder.
Figure 7:
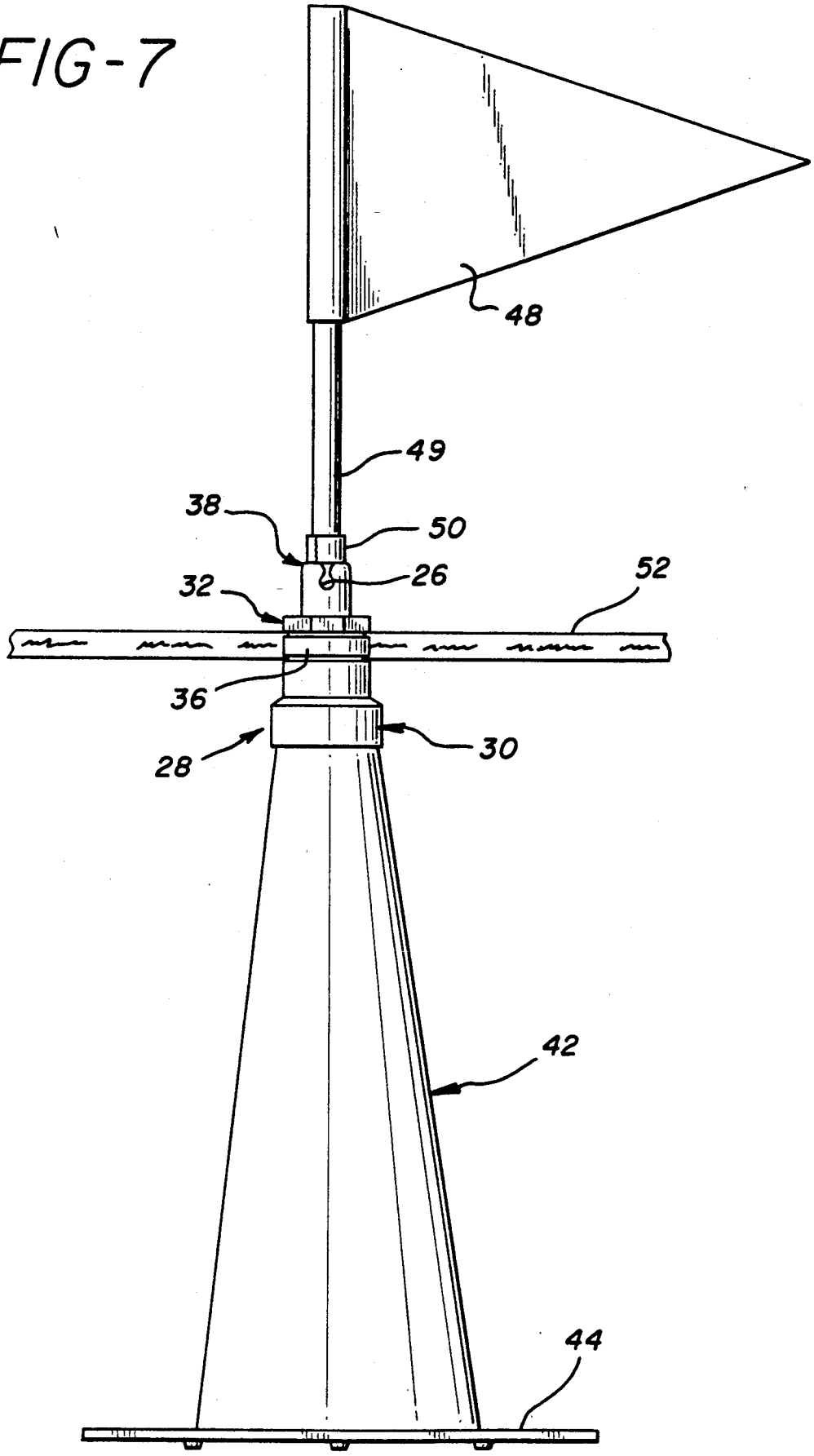
FIG. 7 is a perspective view of one possible embodiment of the traffic control system of the invention showing an adapter connected to a traffic cone with a flag and barricade tape in place on the adapter.

Similarly barricade tape snap on holder 36 (FIG. 4B) is employed to secure barricade tape 52 to traffic cone 42 (FIG. 7) by means of adapter 28. Snap on holder 36 can be made of metal or from a variety of resilient plastic materials. As shown in FIG. 7 barricade tape is placed over recess 34 in adapter 28, the snap on holder is held by handle 37, and the hemispherically shaped snap on holder is frictionally secured over the barricade tape onto recess 34 in adapter 28.

Figure 5:
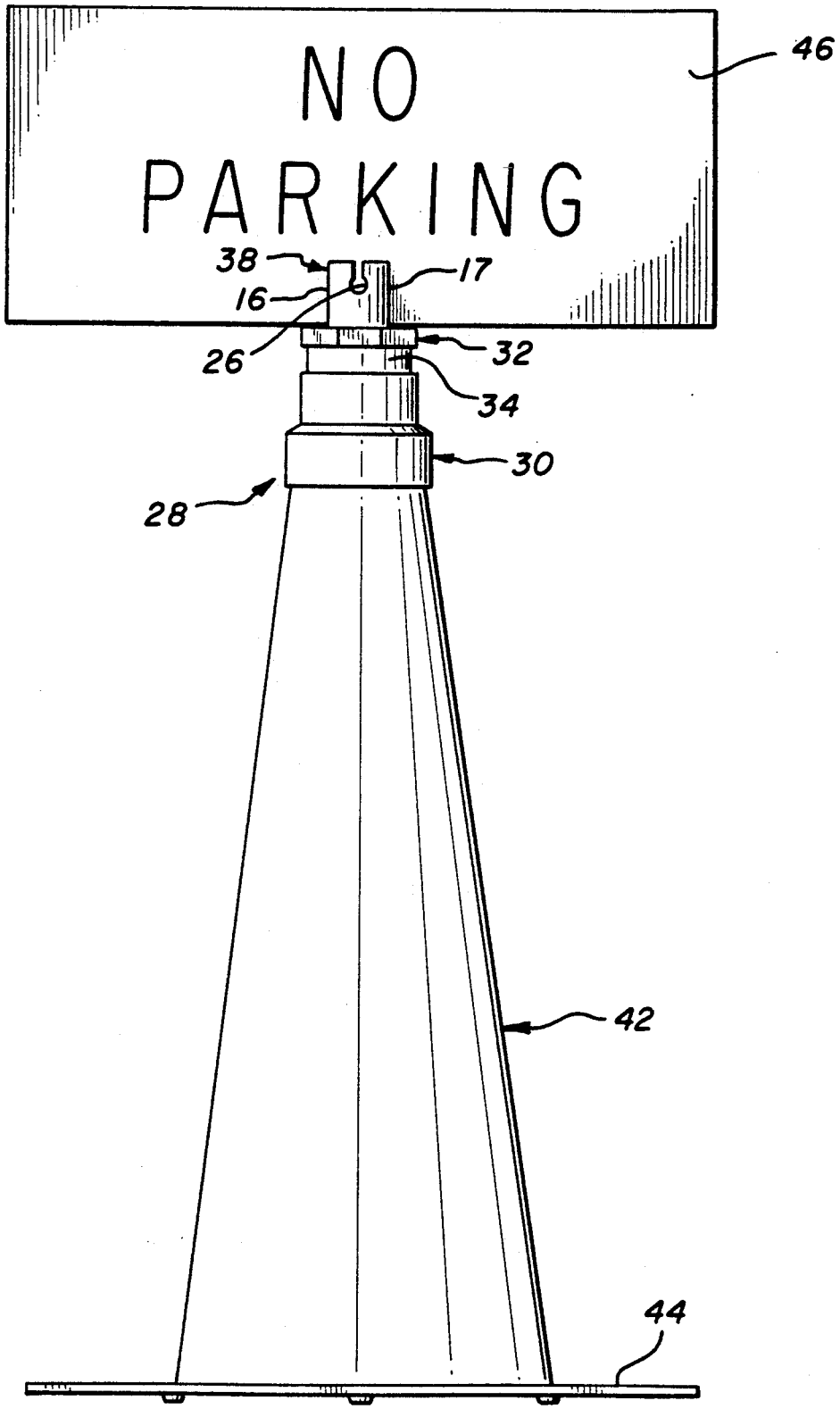
FIG. 5 is a persective view of one possible embodiment of the traffic control system of the invention showing an adapter connected to a traffic cone, with a "No Parking" sign in place on the adapter.

Information sign 46 can be rapidly deployed as shown in FIG. 5. Sign 46 with the legend "No Parking" is shown secured in slots 24, 26, and 25, 27 in adapter 28, which adapter is shown secured in place on traffic cone 42.

In addition to providing means for securing barricade tape to a traffic cone as previously described, FIG. 7 also illustrates the convenient placement of a flag (usually red to indicate danger) on top of a traffic cone 42. In this arrangement the flag staff 49 is placed in the open end 64 (FIG. 3) of adapter 28, and a previously secured taped stop 50 provides the means for positioning flag 48 at a pre-selected height.

Figure 8:
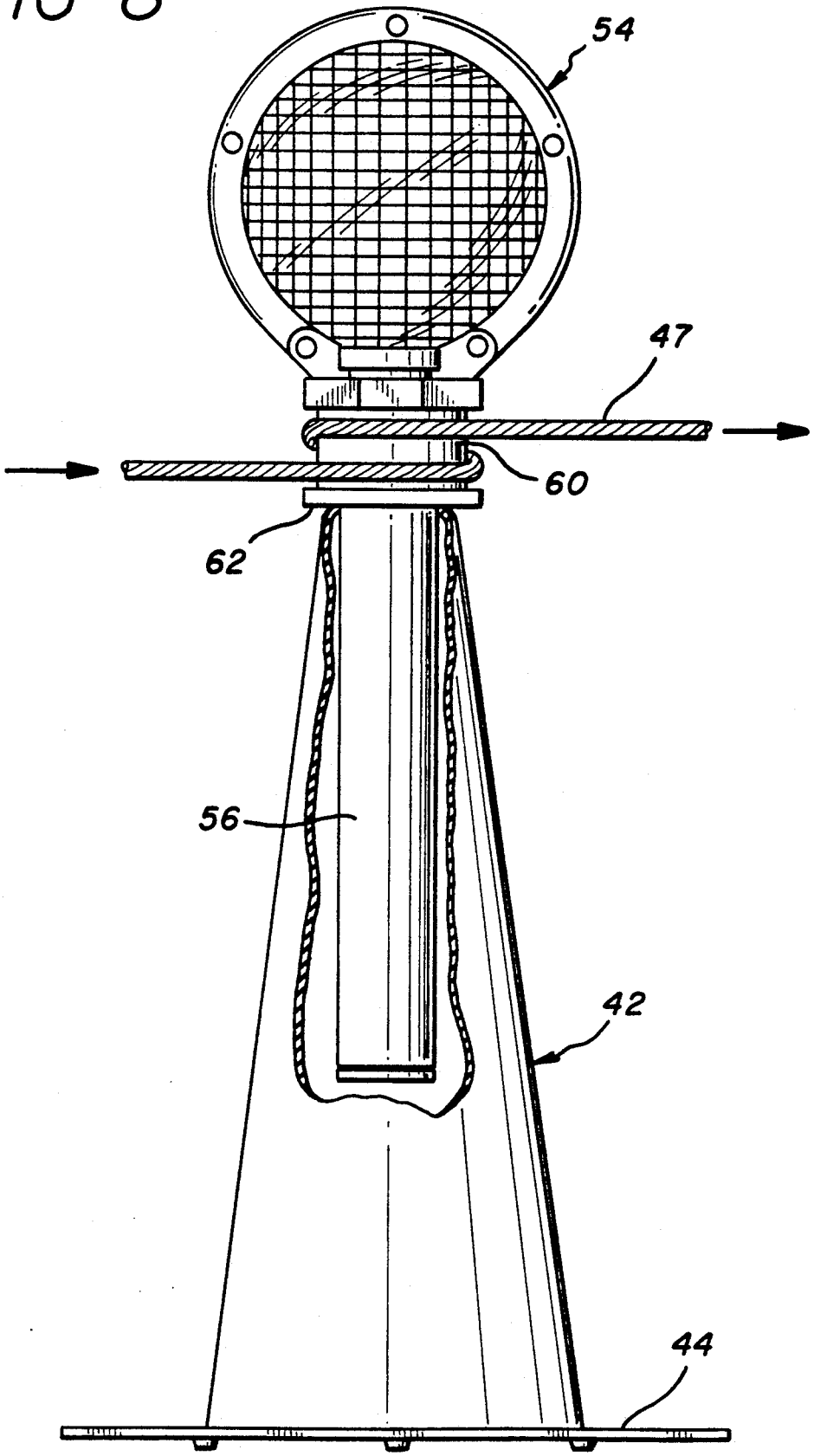
FIG. 8 is a perspective view of one possible embodiment of the traffic control system of the invention showing a warning lamp connected to a traffic cone, and being part of a perimeterized traffic control area delineated by the connected barricade rope, with a portion of the traffic cone cut away to show the battery pack of the warning lamp.

When the system is employed to perimeterize an area for traffic safety control, as, for example, when several traffic cones (connected together by means of barricade rope and/or barricade tape) are used to delineate a traffic control area, battery operated warning lamps 54 (FIG. 8) can be added to the system. The lamp 54 is inserted directly into the open top portion 62 of traffic cone 42, with the neck portion 60 of the lamp serving as a convenient encircling point for the barricade rope 47 and/or barricade tape 52 (FIG. 9) eminating from other traffic cones forming part of the traffic control system. In addition, spring tension clip 40 (FIG. 9) can also be used in conjunction with lamp 54 and traffic cone 42 as an aid for securing barricade tape 52 to the traffic cone/warning lamp combination. Warning lamp battery pack 56 is configured for direct placement within opening 62, providing ballast for lamp 54. The neck portion 60 of lamp 54 extends laterally beyond the top portion of traffic cone 42, forming a secure platform for lamp 54.

Figure 10:
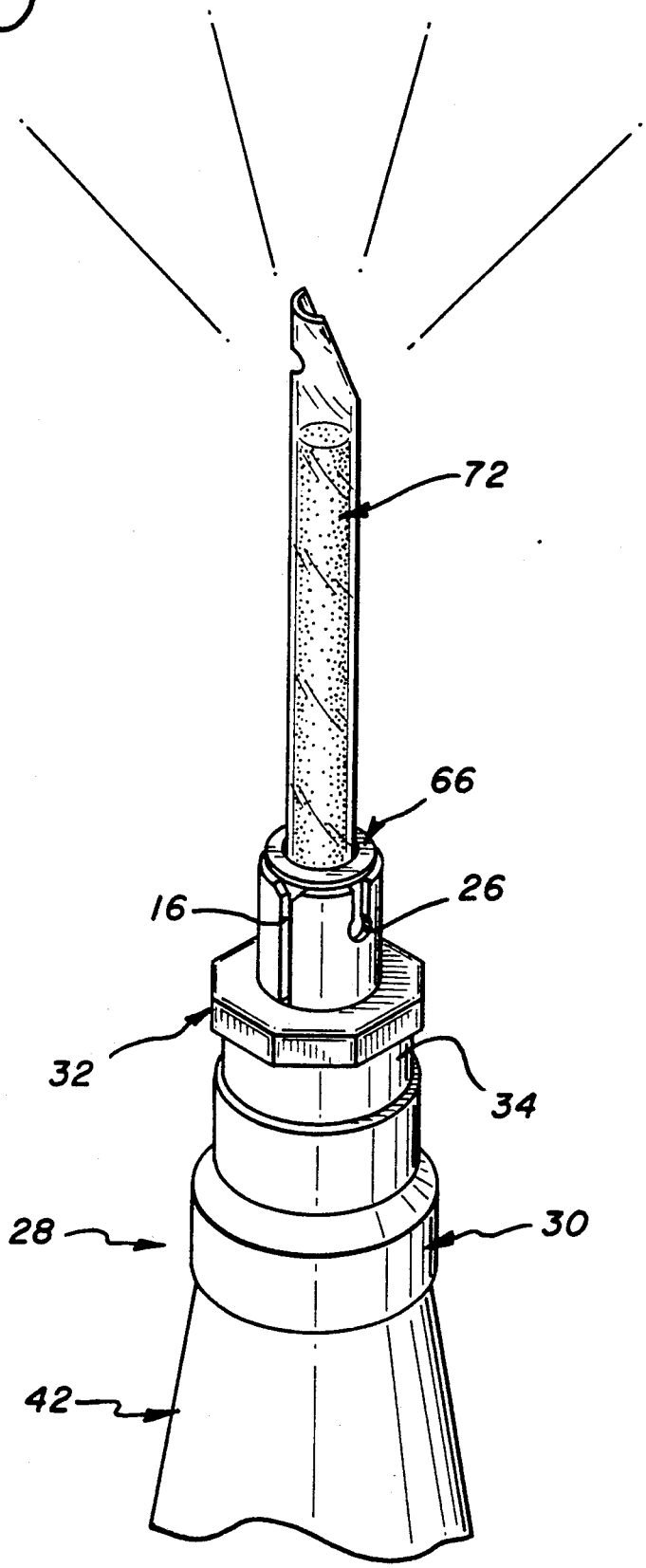
FIG. 10 is a perspective view of one possible embodiment of the traffic control system of the invention showing a chemical light stick in place on the adapter.
Figure 11:
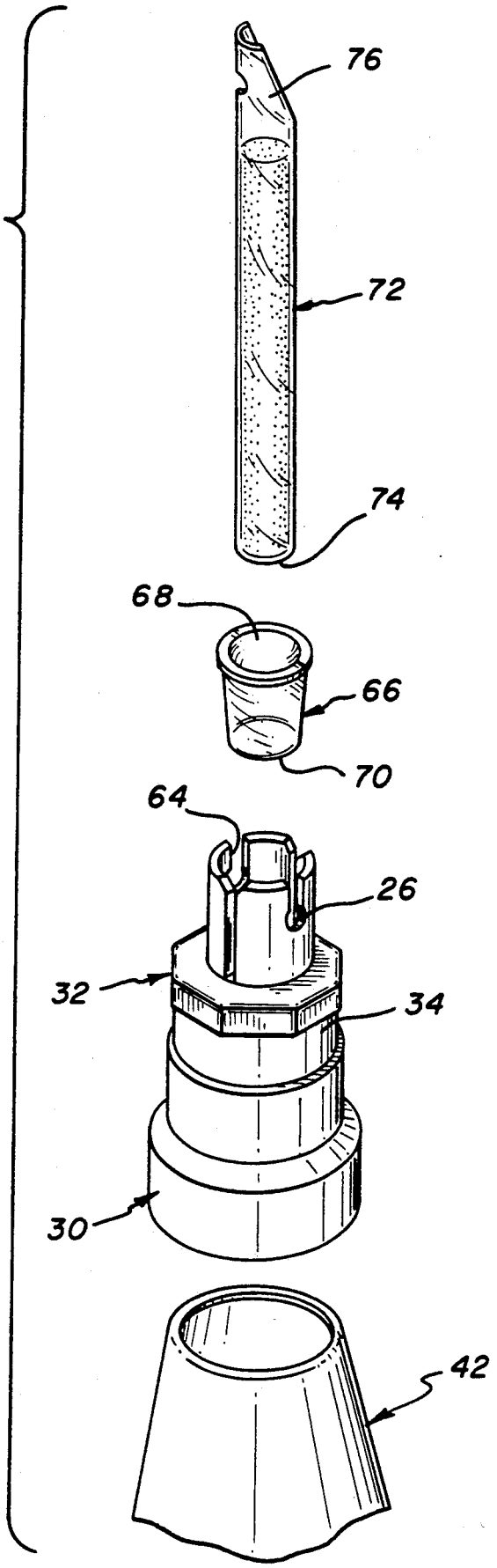
FIG. 11 is an exploded perspective view of the embodiment of the invention shown if FIG. 10.

FIGS. 10 and 11 illustrate a convenient means for connecting a chemical light stick 72 (e.g. Cyalume Light Stick, made by American Cyanamid Company, Chemical Light Department, Milton, Fla. 32570. Cyalume is a registered trademark of American Cyanamid Company.) on top of a traffic cone 42, making use of adapter 28 (FIG. 3). Thimble shaped light stick adapter 66 (FIG. 11) is open at its top 68 and closed at its base 70. The light stick adapter 66 can be fabricated in plastic or metal. Light stick adapter 66 is placed in the opening 64 of adapter 28 with its open top facing upwards away from base 44. In this manner light stick adapter 66 forms a convenient "candle stick" holder for chemical light stick 72. To activate chemical light stick 72, the light stick is bent at its middle portion and is then shaken by hand to mix the light producing chemicals therein, thereby producing light. Base portion 74 of chemical light stick 72 is now placed directly into opening 68 in light stick adapter 66, with the top 76 of light stick 72 facing upwards, away from base 44 of traffic cone 42. Temporary illumination is now provided by the chemical light stick connected to the top of traffic cone 42.

Thus it can be seen that by employing the above described adapters and means for securing barricade tape, and utilizing the system to perimeterize an area with the additional safety factor of a warning lamp, a traffic safety control system is provided making use of standard signs, standard flags with staff, standard barricade rope and standard barricade tape, and standard chemical light stick illumination for rapid, economical deployment on top of standard traffic cones.

While the present invention has been disclosed in connection with the preferred embodiments shown and described in detail, various modifications and improvements thereon will become readily apparent to those skilled in the art. Accordingly, the spirit and scope of the present invention is to be limited only by the following claims:

What is claimed is:

1. A traffic safety control system comprising:

(a) a traffic marker, said marker having a top and a base;

(b) means for connecting an information sign on said top of said marker;

(c) means for connecting a barricade rope to said top of said marker;

(d) means for connecting a barricade tape to said top of said marker; and (e) flag supporting means for supporting a flag and flag staff on said top of said marker wherein said means for connecting said information sign, said rope and said flag and flag staff is a hollow adapter, said adapter having a top and a base, wherein said base of said adapter slip fits over the top of said traffic marker, and said top of said adapter has a first pair of slots for the connection thereto of at least said information sign.

2. A traffic safety control system according to claim 1 wherein said traffic marker is in the shape of a cone.

3. A traffic safety control system according to claim 2 wherein said traffic marker is a standard traffic cone.

4. A traffic safety control system according to claim 1 further comprising means for securing a chemical light stick to said top of said adapter.

5. A traffic safety control system according to claim 1 wherein said adapter is fabricated in plastic.

6. A traffic safety control system according to claim 5 wherein said plastic is polyvinyl chloride.

7. A traffic safety control system according to claim 1 wherein said pair of slots in said open top of said adapter includes means for the connection of said barricade rope.

8. A traffic safety control system according to claim 1 wherein said adapter has at least two pairs of slots in said open top of said adapter for the connection of said information sign and said barricade rope.

9. A traffic safety control system according to claim 1 wherein said adapter has a centrally located recessed area for the placement therein of a means for securing a barricade tape to said adapter.

10. An adapter for securing an information sign to a cone shaped traffic marker wherein said adapter is hollow, said adapter having a top and a base, wherein said base of said adapter slip fits over the top of said traffic marker, and said top of said adapter has a first pair of vertical slots beginning at the open end of said top of said adapter and traversing a spaced distance downward toward said base of said adapter, so that when said information sign is caused to slide into said first slots in said adapter, said sign is frictionally secured to said adapter and said traffic marker.

11. An adapter according to claim 10 wherein said adapter further comprises means for connecting a barricade rope to said adapter and said traffic marker.

12. An adapter according to claim 11 wherein said means for connecting said barricade rope to said adapter is a second pair of vertical slots.

13. An adapter according to claim 12 wherein said first pair of vertical slots in said open top of said adapter is at right angles to said second pair of vertical slots in said open top of said adapter.

14. An adapter according to claim 11 wherein said adapter further comprises means for securing a barricade tape to said adapter and said traffic marker.

15. An adapter according to claim 10 further comprising means for securing a flag and flag staff to said adapter and said marker.

16. An adapter according to claim 10 further comprising means for securing a chemical light stick to said adapter and said marker.

17. An adapter according to claim 10 wherein said adapter is fabricated in plastic.

18. An adapter according to claim 17 wherein said plastic is polyvinyl chloride.

19. An area traffic safety control system for perimeterizing said area, comprising:

(a) at least two traffic markers, each of said markers having a top and a base;

(b) means for connecting a barricade rope to said top of each said marker;

(c) means for connecting a barricade tape to said top of each said marker; and, (d) means for illuminating said area by connecting a warning light to said top of each said marker, wherein said means for connecting said barricade rope, said barricade tape and said warning light to each said marker is a hollow adapter, each said adapter having a top and a base, wherein said base of said adapter slip fits over the top of its respective traffic marker, and said top of each said adapter has at least a first pair of slots for the connection thereto of said information sign and said barricade rope, said adapter further including means for connecting said barricade tape and said warning light thereto, all as desired by the user.

20. An area traffic control system according to claim 19 wherein said warning light is a battery operated warning lamp, with the battery portion of said lamp inserted into an opening at the said top of each said adapter.

21. A method for safely controlling the flow of traffic, which comprises the steps of:

(a) marking an area with at least one traffic cone, each cone having a base and a top;

(b) positioning a hollow adapter, having a top and a base, on said cone, by slipping the base of said adapter over the top of said traffic cone, said adapter having at least a first pair of vertical slots beginning at the open end of said top of said adapter;

(c) warning said traffic away from said area with flags and warning lights, inserted into the top of said adapter, and information signs inserted into said pair of vertical slots, all as desired by the user; and (d) perimeterizing said area, which perimeterizing includes the step of barricading said area by connecting barricade means to said hollow adapters.

22. The method according to claim 21, further comprising the step of illuminating said area, wherein at least one chemical light stick illuminates said area, said chemical light stick inserted in one of said hollow adapters.

23. The method according to claim 21, further comprising the step of illuminating said area, wherein at least one battery operated warning lamp illustrates said area said warning lamp inserted in one of said hollow adapters.

* * * * *